US010738727B2

(12) United States Patent
Adelman

(10) Patent No.: US 10,738,727 B2
(45) Date of Patent: Aug. 11, 2020

(54) ELECTRIC PUMP PRESSURE SENSORLESS ELECTRONIC PRESSURE LIMITING AND FLOW LEVELING SYSTEM

(71) Applicant: Stephen T. Adelman, Grass Valley, CA (US)

(72) Inventor: Stephen T. Adelman, Grass Valley, CA (US)

(73) Assignee: PARAGON PRODUCTS, LLC, El Dorado Hills, CA (US)

( * ) Notice: Subject to any disclaimer, the term of this patent is extended or adjusted under 35 U.S.C. 154(b) by 855 days.

(21) Appl. No.: 15/013,822

(22) Filed: Feb. 2, 2016

(65) Prior Publication Data

US 2016/0237944 A1 Aug. 18, 2016

Related U.S. Application Data

(60) Provisional application No. 62/111,497, filed on Feb. 3, 2015.

(51) Int. Cl.

| | |
|---|---|
| ***F02D 41/30*** | (2006.01) |
| *F02D 41/20* | (2006.01) |
| *F02D 41/32* | (2006.01) |

(52) U.S. Cl.

CPC ..... *F02D 41/3082* (2013.01); *F02D 41/32* (2013.01); *F02D 2041/2048* (2013.01);

(Continued)

(58) Field of Classification Search

CPC ..... F02D 41/3082; F02D 2041/2058; F02D 2041/2048; F02D 41/38; F02D 41/32; F02D 2041/2051

See application file for complete search history.

(56) References Cited

U.S. PATENT DOCUMENTS

| | | | |
|---|---|---|---|
| 4,827,897 | A | 5/1989 | Yamada et al. |
| 5,042,445 | A | 8/1991 | Peters et al. |

(Continued)

FOREIGN PATENT DOCUMENTS

| | | | |
|---|---|---|---|
| EP | 0016236 | A1 | 10/1980 |
| JP | 57193766 | A | 11/1982 |

(Continued)

OTHER PUBLICATIONS

Performance Diesel Warehouse, Inc., Power Edge EZ, website © 2010.

(Continued)

*Primary Examiner* — Charles G Freay
*Assistant Examiner* — Lilya Pekarskaya
(74) *Attorney, Agent, or Firm* — Weintraub Tobin

(57) ABSTRACT

A pressure sensorless electronic pressure limiting and flow leveling system for an electric pump comprising a multi-mode control process for transferring fluid through a filter feeding a source consuming the fluid as the filter becomes clogged. The multi-mode control process comprising a closed loop current control mode, a pressure limiting control mode for controlling the speed of the motor as a function of a pre-calibrated profile correlating measured motor speed and voltage parameters to a predetermined value in the pre-calibrated profile utilized to set the speed of the motor driving the pump for pumping pressurized fluid through a clogging filter; and a flow leveling control mode correlating measured motor current to a predetermined value in a pre-calibrated profile utilized to set the speed of the motor driving the pump for pumping pressurized fluid as a function of clogging of the filter.

12 Claims, 8 Drawing Sheets

(52) U.S. Cl.
CPC ..... *F02D 2041/2051* (2013.01); *F02D 2041/2058* (2013.01)

(56) References Cited

U.S. PATENT DOCUMENTS

| | | | |
|---|---|---|---|
| 5,398,655 | A | 3/1995 | Tuckey |
| 5,406,922 | A | 4/1995 | Tuckey |
| 5,411,002 | A | 5/1995 | Smitley |
| 5,445,128 | A | 8/1995 | Letang et al. |
| 5,605,448 | A | 2/1997 | Martin, Sr. |
| 5,908,286 | A | 6/1999 | Clemmons |
| 5,992,474 | A | 11/1999 | Miller |
| 6,119,655 | A | 9/2000 | Heinitz et al. |
| 6,209,521 | B1 | 4/2001 | Rembold et al. |
| 6,453,878 | B1 | 9/2002 | Mazet |
| 6,560,528 | B1 | 5/2003 | Gitlin et al. |
| 6,579,137 | B2 | 6/2003 | Mabru |
| 6,609,501 | B2 | 8/2003 | Doane et al. |
| 6,647,328 | B2 | 11/2003 | Walker |
| 6,672,147 | B1 | 1/2004 | Mazet |
| 6,925,990 | B1 | 8/2005 | Konopacki |
| 8,707,932 | B1 * | 4/2014 | Marin ..... F02D 41/3082 123/479 |
| 2005/0229906 | A1 | 10/2005 | Hosoya |
| 2009/0187326 | A1 | 7/2009 | Rozman et al. |
| 2009/0204308 | A1 | 8/2009 | Manan et al. |
| 2010/0066288 | A1 | 3/2010 | Williams |

FOREIGN PATENT DOCUMENTS

| | | | |
|---|---|---|---|
| JP | 61023838 | A | 2/1986 |
| KR | 20030033264 | A | 5/2003 |
| KR | 20030081676 | A | 10/2003 |

OTHER PUBLICATIONS

Scope It Out: Automotive Videos News Blog, Exploring the Duramax, website, Oct. 20, 2009.

* cited by examiner

ELECTRIC PUMP PRESSURE SENSORLESS ELECTRONIC PRESSURE LIMITING AND FLOW LEVELING SYSTEM

CROSS-REFERENCE TO RELATED APPLICATIONS

This application claims priority under 35 USC Section 119(e) to U.S. Provisional Patent Application No. 62/111,497, filed Feb. 3, 2015, the entire disclosure of which is incorporated herein by reference.

FIELD OF THE INVENTION

This invention relates generally to an electric pump pressure and flow limitation system and, in particular, to a pressure sensorless electronic pressure limiting and flow leveling system for an electric pump.

BACKGROUND OF THE INVENTION

In fluid pumping applications using positive displacement pumps, the pump creates flow. A restriction to the flow created by a system downstream from the pump creates pump back pressure. High back pressure is problematic because it is known to cause various mechanical failures including accelerated pump wear due excessive pump loading, pump failure, and leaks or failure of downstream system components of the pump, such as hoses, hose fittings, filters canisters, and manifolds.

To protect against over pressurization in these systems, a mechanical high pressure bypass or pressure regulating valve is commonly employed. These valves usually consist of a ball bearing closing an inlet by being pressed against an inlet circumscribing machined surface by a spring sitting on an adjustable seat. Moving the adjustable seat towards the ball bearing compresses the spring thereby increasing the fluid pressure required at the inlet to dislodge the ball. Decreasing the spring pressure will allow fluid to escape through the inlet at lower pressures.

Accordingly, the venting of fluid from the system at a desired set point is dependent on the proper and successful operation of the bypass valve to protect the pump and other components from exposure to pressures above the system design. Notwithstanding, the mechanical high pressure bypass valves in some applications can be difficult to tune.

Additionally, it is possible for instabilities to arise within more complex systems causing the bypass valve to oscillate open and close. The resulting pressure fluctuations are generally unacceptable. Accordingly, bypass valves are subject to wear, degraded performance, and ultimately failure. A failed valve will usually compromise the system, causing unacceptably high bypass flow as a result of the valve opening or leaking at low pressure under otherwise normal conditions thereby requiring replacement.

Furthermore, high pressure relief valves, associated fittings, and tank return hosing can be a significant portion of total system cost. The percentage will vary with system design and complexity, but the point holds true: cost is an important consideration for pump systems on, for example mobile engine fuels systems.

In systems trying to achieve a constant flow design, the systems must be sized large enough and are generally oversized to accommodate the system downstream flow demand and any planned flow through the high pressure bypass.

Moreover, constant speed pumps are not constant flow for many types of positive displacement pumps. Volumetric efficiency varies as back pressure changes. For example, higher back pressure causes more leakage and recirculation within the pump leading to a change in flow which can be large depending on the pressure range and pump construction. This again results in a general use of an oversized system since a constant speed pump must be sized large enough to supply the system load when the system restriction (back pressure) is at its maximum design point.

For the foregoing reasons, there is a need to ameliorate or overcome one or more of the significant shortcomings delineated hereinabove.

BRIEF SUMMARY OF THE INVENTION

Accordingly, and in one aspect, an embodiment of the invention ameliorates or overcomes one or more of the significant shortcomings delineated hereinabove by providing an electric pump pressure sensorless electronic pressure limiting and flow leveling system: apparatus and method comprising a variable speed electric pump motor controlled by a microprocessor configured with a multi-mode control process comprising a base current control profile process, a pressure limiting current control modification profile process, and a flow leveling current control modification profile process utilizing a correlative empirically determined pressure limiting profile and/or a flow leveling profile to solve the problem of pressure relief.

More particularly, and in one aspect, an embodiment of the system limits the maximum pressure with a system configuration of the multi-mode control process utilizing low cost transducer measurements within the pump/motor assembly only and without a pressure measurement, rendering the relatively high cost mechanical bypass valve unnecessary. At a minimum the microprocessor controlling the pump motor must command motor stator frequency and measure the total current draw of the motor/controller unit. With these two parameters and the multi-mode control processes configured within the microprocessor, a control schedule is created that limits the maximum pressure the pump can create. The multi-mode control process can be employed with a variety of variable speed motor/controller architectures. For example, AC induction and PMSM (trapezoidal or sinusoidal wound) systems can utilize the advantage of the multi-mode control process. Additionally, an embodiment of the multi-mode control process further determines rotor speed for use as a further parameter of use by the multi-mode process.

Furthermore, the multi-mode control process utilizes a voltage measurement of the source feeding the motor inverter to allow for corrections to systems with varying voltage supplies, such as mobile engine systems operating from a battery at start up and an alternator when the engine is running, or when either of those two components degrade. Accordingly, the multi-mode control process can compensate for higher or lower voltages, but as voltage drops the flow and pressure capability will ultimately drop below the motors ability to maintain a desired minimum flow.

In another aspect, a method is provided for controlling a fluid pump delivering fluid through a filter feeding a fluid consuming system; said method comprising: providing a fluid pump having an inlet port which is connectable in fluid communication with a fluid source and an outlet port which is connectable in fluid communication with a filter feeding a fluid consuming system; providing a motor for driving the fluid pump for drawing fluid through the inlet port from the fluid source and pumping pressurized fluid out the outlet port and through the filter feeding the fluid consuming system; measuring a current utilized in operating the motor for driving the fluid pump; controlling an operating speed of the motor driving the fluid pump as a function of the measured current and a reference current for defining a closed loop current control mode; measuring an operating speed of the motor driving the fluid pump and measuring a voltage utilized in operating the motor for driving the fluid pump; correlating the measured operating speed and the measured voltage to a value in a pressure limiting correction profile for defining a correlated correction profile value; and transitioning from the closed loop current control mode to a pressure limiting control mode for controlling the operating speed of the motor by utilizing the correlated correction profile value from the pressure limiting correction profile for setting the speed of the motor driving the fluid pump for drawing fluid through the inlet port from the fluid source and pumping pressurized fluid out the outlet port and through the filter feeding the fluid consuming system.

In another aspect, a method is provided for controlling a fluid pump delivering fluid through a filter feeding a fluid consuming system; said method comprising: providing a fluid pump having an inlet port which is connectable in fluid communication with a fluid source and an outlet port which is connectable in fluid communication with a filter feeding a fluid consuming system; providing a motor for driving the fluid pump for drawing fluid through the inlet port from the fluid source and pumping pressurized fluid out the outlet port and through the filter feeding the fluid consuming system; measuring a current utilized in operating the motor for driving the fluid pump; controlling an operating speed of the motor driving the fluid pump as a function of the measured current and a reference current for defining a closed loop current control mode; correlating the measured current to a value in a flow leveling correction profile for defining a correlated flow leveling correction profile value; and transitioning from the closed loop current control mode to a flow leveling control mode for controlling the operating speed of the motor by utilizing the correlated flow leveling correction profile value from the flow leveling correction profile for setting the speed of the motor driving the fluid pump for drawing fluid through the inlet port from the fluid source and pumping pressurized fluid out the outlet port and through the filter feeding the fluid consuming system.

In another aspect, a system is provided for controlling a fluid pump delivering fluid through a filter feeding a fluid consuming system; said system comprising: a fluid pump having an inlet port which is connectable in fluid communication with a fluid source and an outlet port which is connectable in fluid communication with a filter feeding a fluid consuming system; a motor for driving the fluid pump for drawing fluid through the inlet port from the fluid source and pumping pressurized fluid out the outlet port and through the filter feeding the fluid consuming system; means for measuring a current utilized in operating the motor for driving the fluid pump; means for controlling an operating speed of the motor driving the fluid pump as a function of the measured current and a reference current for defining a closed loop current control mode; means for measuring an operating speed of the motor driving the fluid pump and measuring a voltage utilized in operating the motor for driving the fluid pump; means for correlating the measured operating speed and the measured voltage to a value in a pressure limiting correction profile for defining a correlated correction profile value; and means for transitioning from the closed loop current control mode to a pressure limiting control mode for controlling the operating speed of the motor by utilizing the correlated correction profile value from the pressure limiting correction profile to set the speed of the motor driving the fluid pump for drawing fluid through the inlet port from the fluid source and pumping pressurized fluid out the outlet port and through the filter feeding the fluid consuming system.

Accordingly, it should be apparent that numerous modifications and adaptations may be resorted to without departing from the scope and fair meaning of the claims as set forth herein below following the detailed description of the invention.

DETAILED DESCRIPTION OF THE INVENTION

Figure 1:
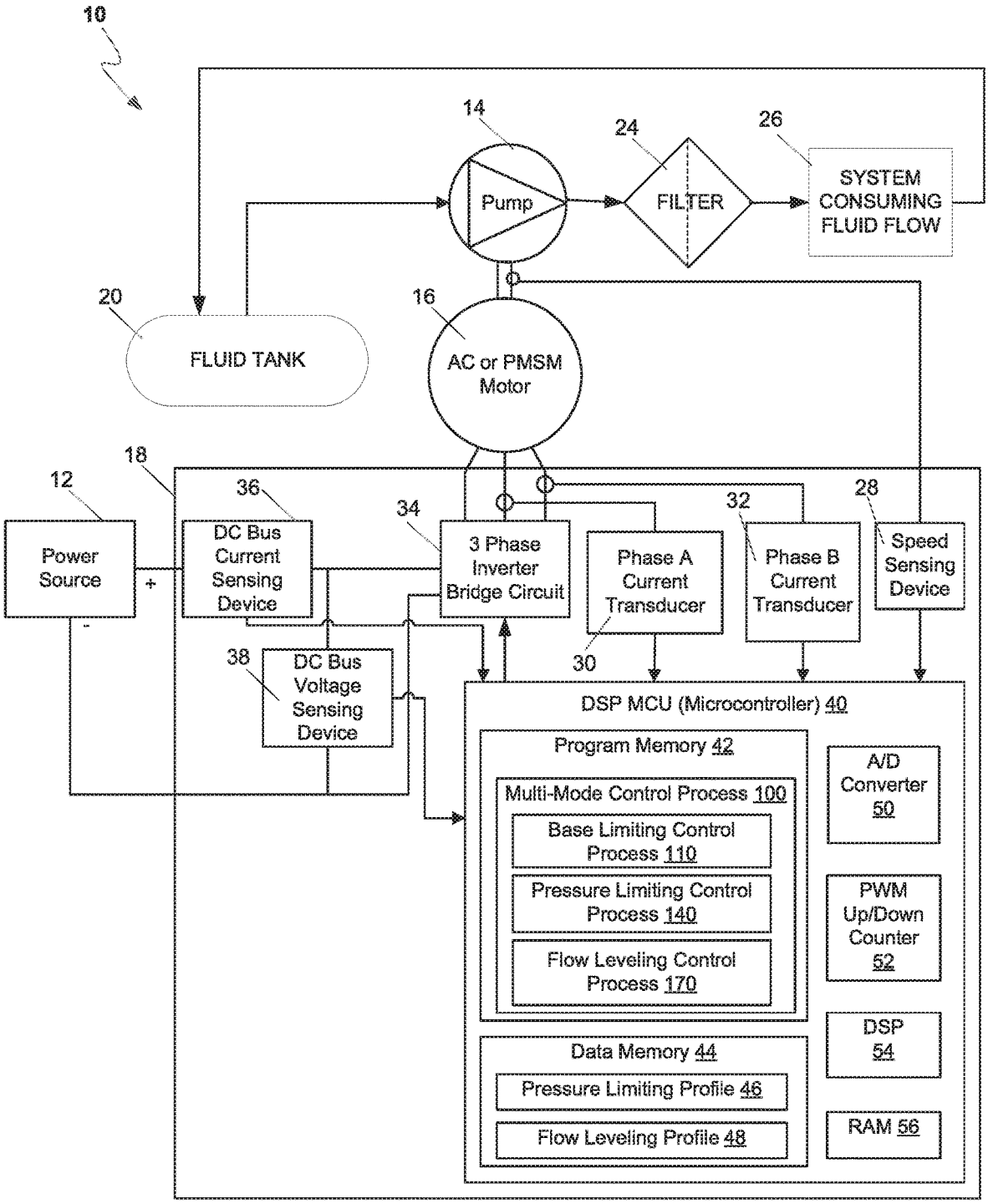
FIG. 1 is a functional block diagram view of an embodiment of an electric pump pressure sensorless electronic pressure limiting and flow leveling system operatively coupled between a fluid tank and at least one filter feeding filtered fluid to a fluid flow consuming system.

Considering the drawings, wherein like reference numerals denote like parts throughout the various drawing figures, reference numeral 10 is directed to an electric pump pressure sensorless electronic pressure limiting and flow leveling system: apparatus and method.

System Overview

Referring to FIG. 1, the system 10 is powered from an external power source 12 and is comprised of a fluid transfer pump 14, an AC induction or PMSM motor 16 for driving the pump 14, and an inverter system 18 comprising a 3-phase inverter bridge circuit 34 controlled by a microcontroller 40 for controlling motor 16 for driving pump 14.

Under the control of the inverter bridge circuit 34, orchestrated by microcontroller 40, the motor 16 drives the pump 14 for drawing or inducing fluid flow from a fluid tank 20 and into the pump 14 via a first fuel line wherein the pump 14 raises the pressure of the fluid flow from a generally ambient condition to a target flow and pumps the pressurized fluid through an outlet fuel filter 24 to, via a second fuel line, a fluid flow consuming system 26.

In one embodiment, the system 10 is also comprised of speed sensing device or transducer 28 for measuring motor output RPM of motor 16 or pump drive speed of pump 14. In one embodiment, the system 10 is further comprised of phase A and B current transducers 30 and 32. Additionally, a DC bus current sensing device 36 is operatively coupled to power source 12 to provide the microcontroller 40 with DC bus output current measurements and a DC bus voltage device 38 is operatively coupled to power source 12 to provide the microcontroller 40 with DC bus output voltage measurements.

It is noted that the system 10 is devoid of and negates the need for a pressure transducer located downstream from the fluid transfer pump for measuring the inlet fuel pressure to the fluid flow consuming system 26.

More specifically, and referring to FIG. 1, an embodiment of the system 10 comprises the inverter system 18 comprised of the digital signal processor microcontroller device 40, abbreviated as microcontroller 40, operatively coupled to the 3-phase inverter bridge circuit 34.

A DC bus electrically couples the power source 12 to the 3-phase inverter bridge circuit 34. In one embodiment, the power source 12 can take the form of, but is not limited to, a DC battery.

Additionally, the inverter system 18 is comprised of the DC bus current sensing device 36, the DC bus voltage sensing device 38, the first or phase-A current transducer 30, and the second or phase-B current transducer 32.

The DC bus voltage sensing device 38 and the DC bus current transducer 36 are both electrically coupled between the DC bus and the microcontroller 40. The first or phase-A current transducer 30 and the second or phase-B current transducer means 32 are both electrically coupled between the motor 16 and the microcontroller 40.

Furthermore, the microcontroller 40 is comprised of an Analog to Digital (A/D) converter 50 for sampling an output of the DC bus current sensing device 36, an output of the DC bus voltage sensing device 38 for obtaining, and outputs of the current transducers 30, 32 for measuring a first or phase-A current and a second or phase-B current.

Moreover, an embodiment of the microcontroller 40 comprises a program memory 42, a data memory 44 which, in one embodiment, is in a form of an EEPROM (Profiles can reside in program memory (fixed) or EEPROM (reprogrammable)), a PWM up/down counter 52, a digital signal processor (DSP) 54, and RAM 56.

Multi-Mode Control Process/Method Overview

FIGS. 1 through 8 illustrate an embodiment of the system 10 comprising a multi-mode control process 100 for controlling the motor 16 for driving pump 14 for pumping fluid through the filter 24 to the fluid flow consuming system 26.

Figure 6:
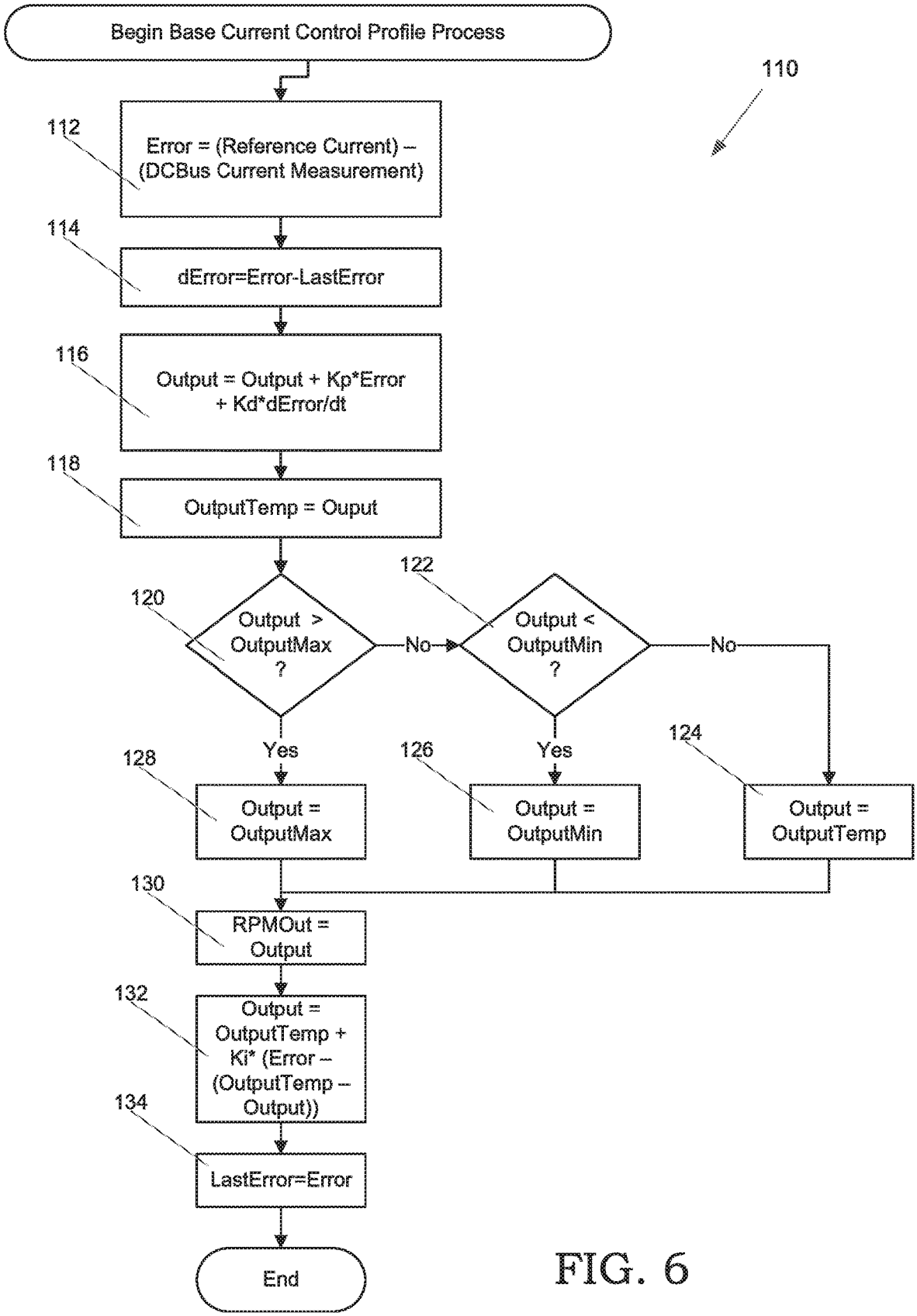
FIG. 6 is a flowchart view that details an embodiment of a base current control profile process of an embodiment of a multi-mode control process of the electric pump pressure sensorless electronic pressure limiting and flow leveling system.
Figure 7:
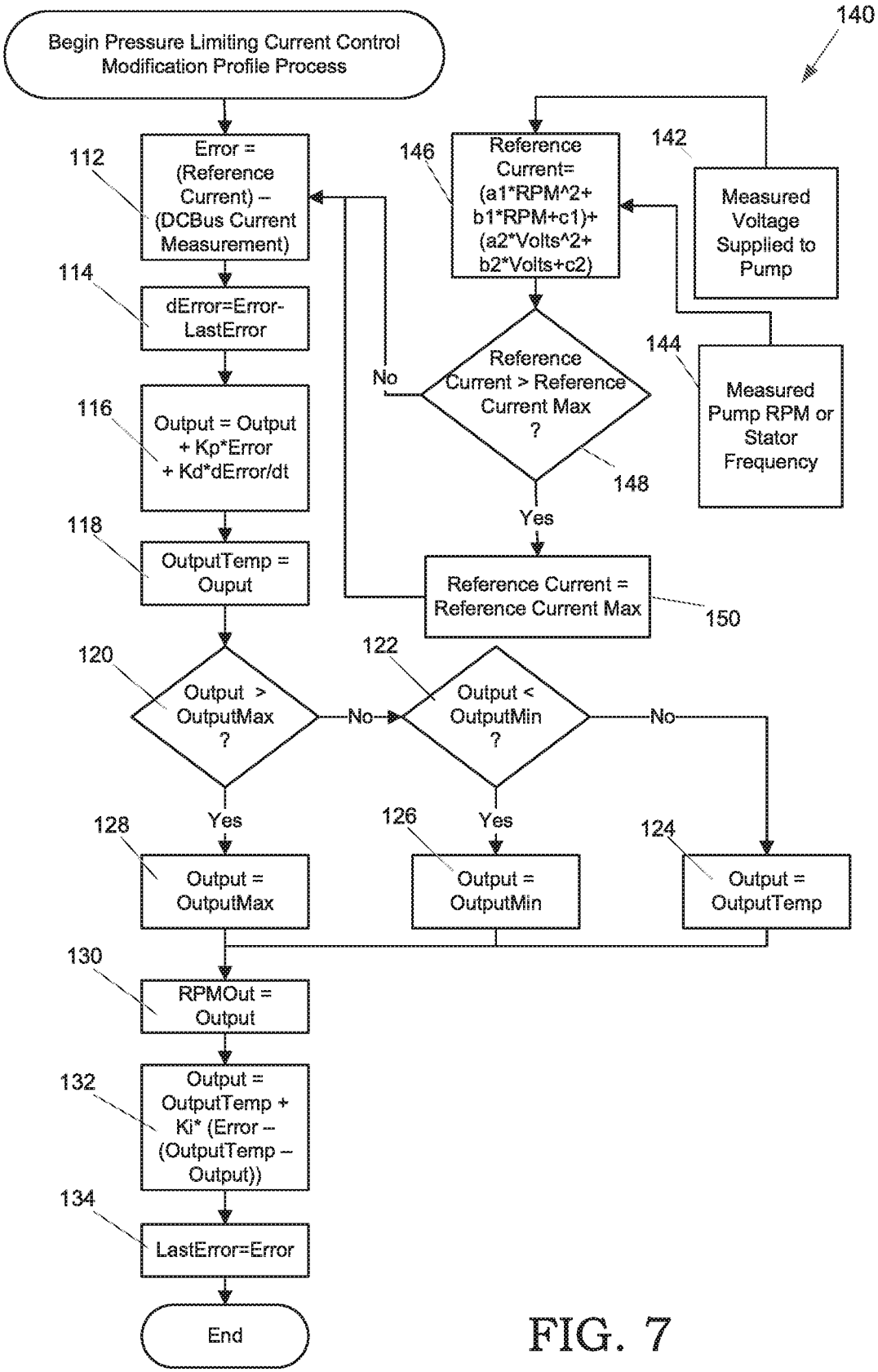
FIG. 7 is a flowchart view that details an embodiment of a pressure limiting current control modification profile process of an embodiment of a multi-mode control process of the electric pump pressure sensorless electronic pressure limiting and flow leveling system.
Figure 8:
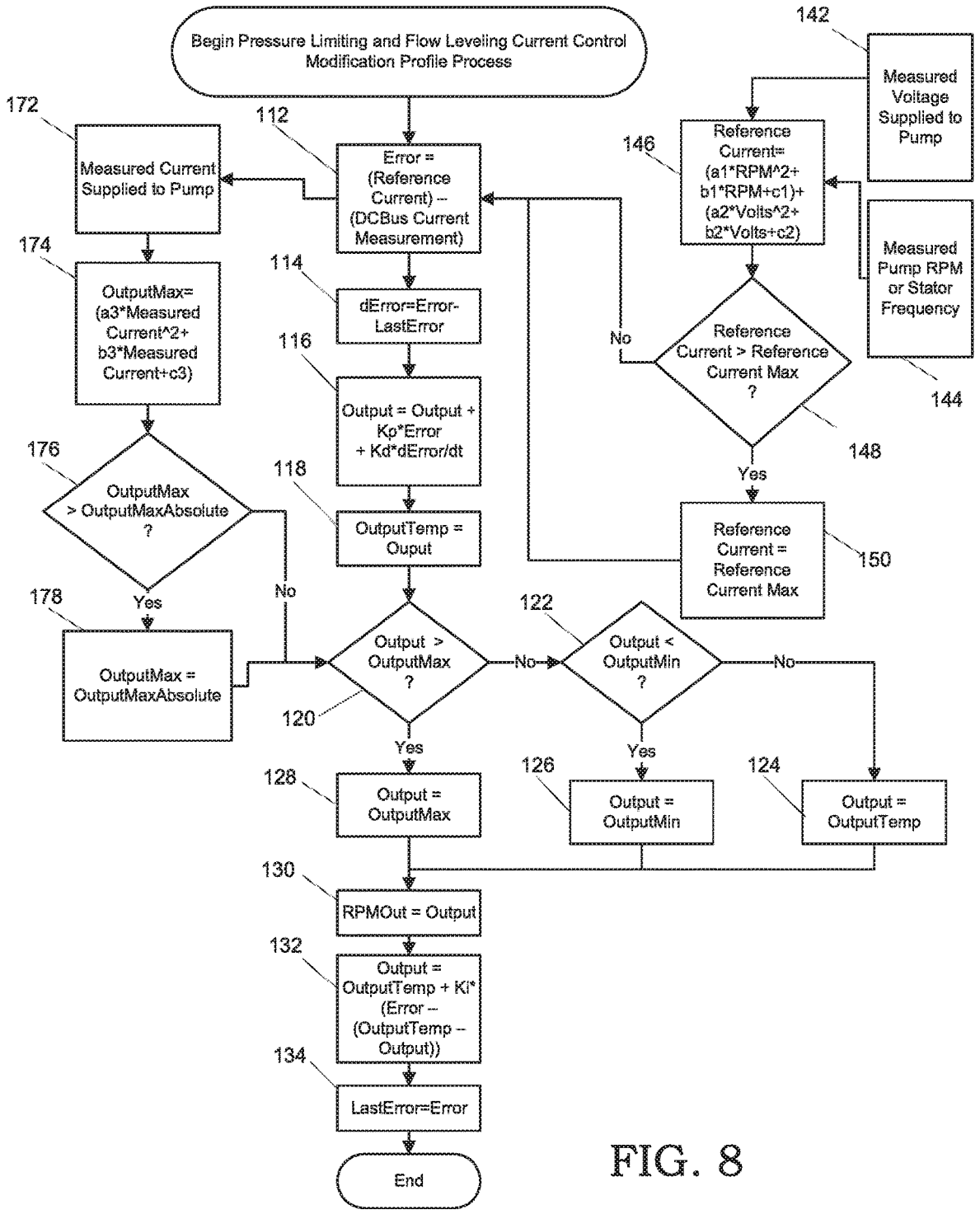
FIG. 8 is a flowchart view that details an embodiment of the pressure limiting current control modification profile process combined with an embodiment of a flow leveling current control modification profile process of an embodiment of a multi-mode control process of the electric pump pressure sensorless electronic pressure limiting and flow leveling system.

The multi-mode control process 100 is comprised of coded instructions that are stored in a program memory 42 of the microcontroller 40 and, in particular, coded instructions for a base limiting control process 110 or, more particularly, a base current control profile process 110, a pressure limiting control process 140 or, more particularly, a pressure limiting current control modification profile process 140, and a flow leveling control process 170 or, in particular, a flow leveling current control modification profile process 170 respectively illustrated in flowchart form in FIGS. 6 through 8.

In one embodiment, the program memory 42 is a non-transitory microcontroller-readable medium such as non-volatile flash memory that stores coded instructions embodying or utilized by any one or more of the processes or methods described herein. The coded instructions may also reside, completely or at least partially, within the RAM memory 56 and/or within the DSP 54 of the microcontroller 40 during execution thereof by the microcontroller 40 wherein the RAM memory 56 and the DSP 54 also constitute non-transitory microcontroller-readable media.

The microcontroller 40 is also comprised of data memory 44 (FIG. 1) such as a non-volatile EEPROM for storing static or working data, look-up tables, formulas, profiles, or curves.

Accordingly, the system 10 comprises the variable speed electric pump motor 14 controlled by microprocessor 40 configured with the base limiting current control profile modification process 110, the pressure limiting current control modification profile process 140, and the flow leveling current control modification profile process 170 utilizing the correlative pressure limiting profile 46 and/or the flow leveling profile 48 to solve the problem of pressure relief.

The system 10 limits the maximum pressure programmatically using low cost transducer measurements within the pump/motor assembly only and without a pressure measurement, rendering the relatively high cost mechanical bypass valve unnecessary. At a minimum the microprocessor 40 controlling the pump motor 16 must command motor stator frequency and measure the total current draw of the motor/controller unit. With these two parameters and the control processes configured within the microprocessor 40 and detailed herein, a control schedule is created that limits the maximum pressure the pump can create.

The multi-mode control process 100 can be employed with any variable speed motor/controller architecture. AC induction and PMSM (trapezoidal or sinusoidal wound) systems can utilize the advantage of the multi-mode control process 100.

As noted, the minimum requirements are measurements of the total current draw at the voltage input to the inverter 34 feeding the electric motor 16 and the output stator frequency. The process 100 can be further improved if the rotor speed is known. How the rotor speed is determined could be from, but not limited to, a speed measurement directly from speed sensing device or transducer 28 or from an estimator if vector control has been implemented using Hall phase current measurements (30 and 32) to sense the motor back-EMF.

A voltage measurement of the source feeding the motor inverter 34 also allows for corrections to systems with varying voltage supplies, such as mobile engine systems operating from a battery at start up and an alternator when the engine is running, or when either of those two components degrade.

The multi-mode control process 100 can compensate for higher or lower voltages, but as voltage drops the flow and pressure capability will ultimately drop below the motors ability to maintain a desired minimum flow.

When using an integer processor for pump motor control, it is necessary to carry 32 bits of resolution in the process calculations. The multi-mode control process 100 utilizes quadratic functions and multiplication with 16 bit resolution will introduce discontinuities to what would be in floating point representation, a smooth function. The discontinuities can cause the algorithm to get trapped at a fixed point in the control envelope.

If the processor has a digital signal processing unit such as DSP 54 (as many motor control microprocessor do) than the calculations can be streamlined and will require fewer clock cycles.

Base Current Control Profile Process

Figure 2:
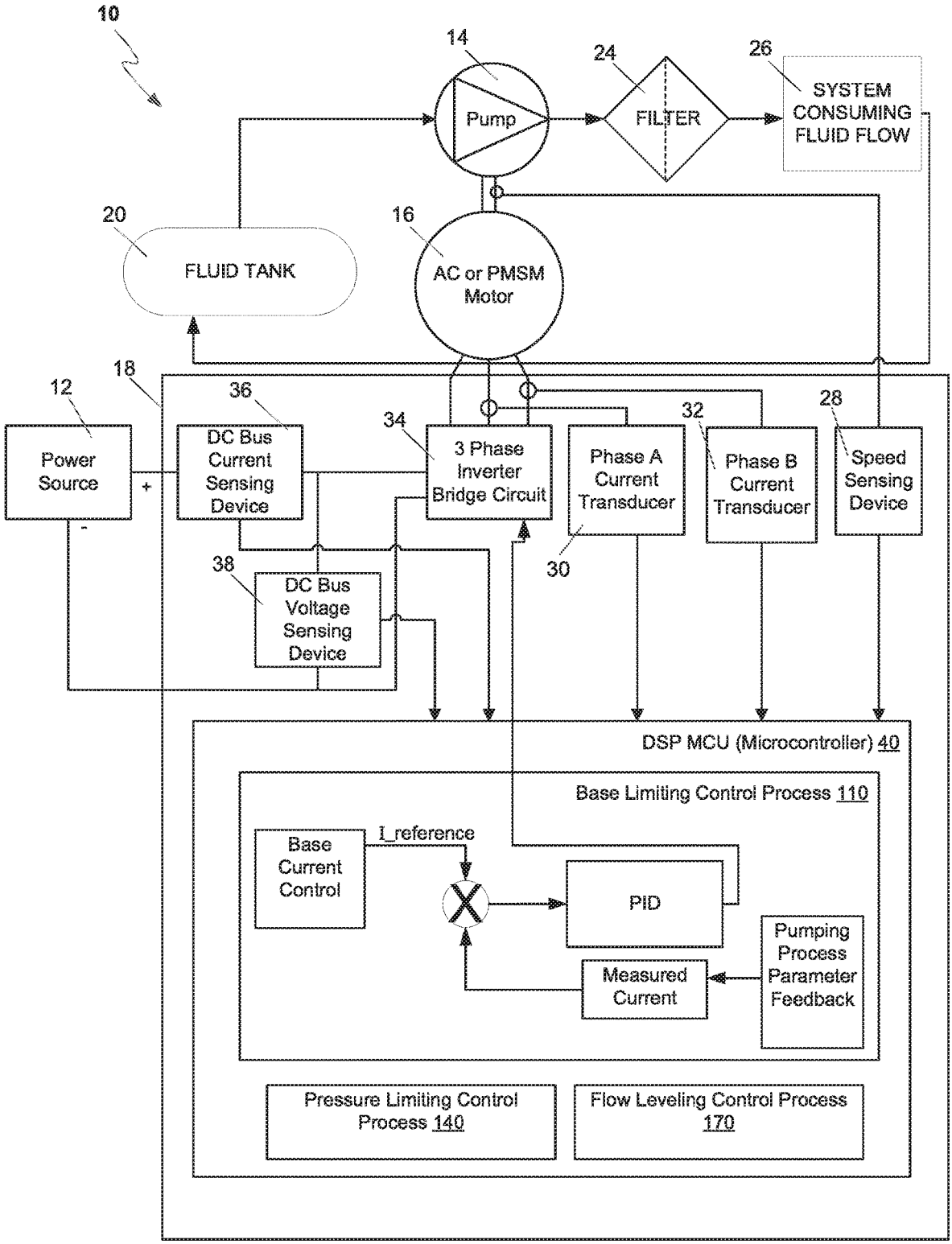
FIG. 2 is a functional block diagram view of an embodiment of the electric pump pressure sensorless electronic pressure limiting and flow leveling system operatively coupled between the fluid tank and at least one filter feeding filtered fluid to the fluid flow consuming system and further illustrating a base current control profile paradigm.

FIG. 2 diagrammatically depicts the base current control profile process 110 comprising a PID control loop using a reference current (Iref). An error signal PID input (Ierror) is generated by comparing the reference current (Iref) with the current measured at the source input (Isource) which is, as illustrated, the total current draw at the voltage input to the inverter 34 feeding the electric motor 16.

The PID loop outputs motor stator frequency (fs) with minimum (fsmin) and maximum (fsmax) limits applied and with, in one embodiment, no windup allowed.

As time progresses, the PID calculation will try to vary the motor frequency such that the error signal is driven to zero and the pump current draw (Isource) is equal to the reference value (Iref). However, at low back pressures the PID output will be limited by a maximum stator frequency (fsmax).

Accordingly, the error signal cannot drive to zero because a maximum stator frequency has been reached and current draw cannot go higher. This configuration results in a constant pump motor speed command until the pump back pressure builds high enough to bring the current draw equal to the reference current and therefore the error signal to zero. When the back pressure is high enough for the motor current draw to exceed the reference current, the PID output will begin to decrease the pump speed and limit the pump flow output and therefore the buildup of back pressure.

Figure 5:
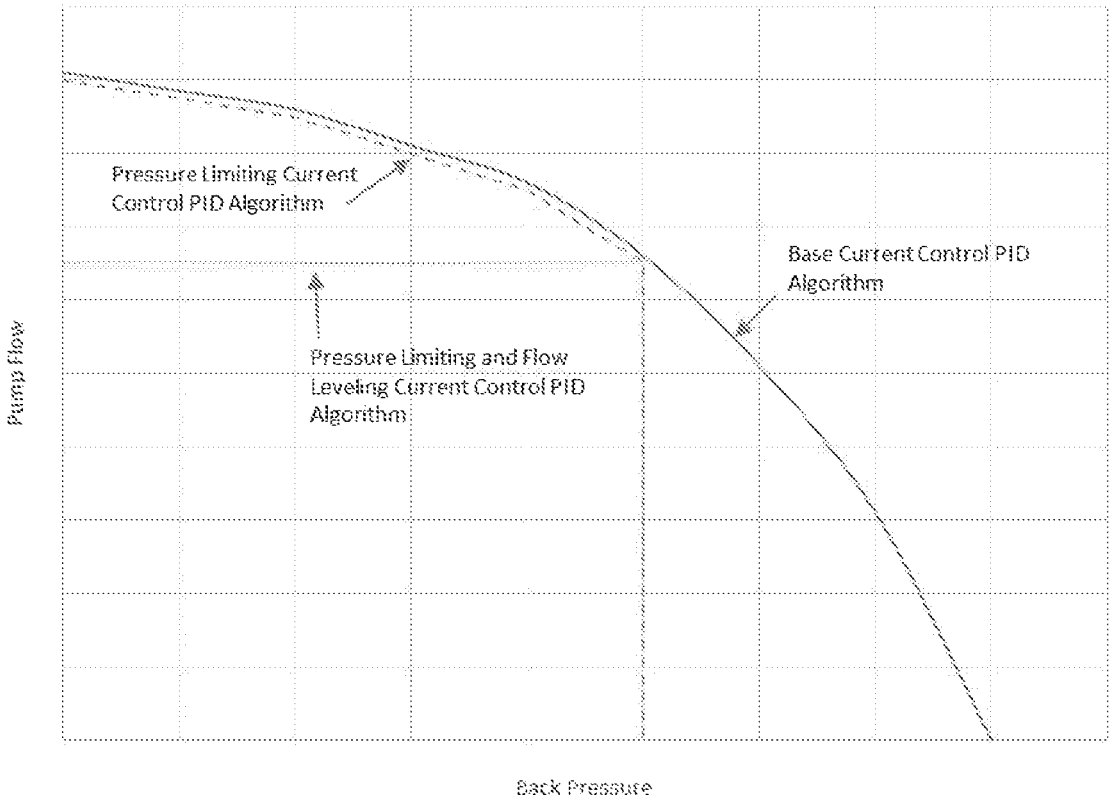
FIG. 5 is a plot of three pump flow versus back pressure curves for graphically illustrating the base current control profile paradigm, the pressure limiting current control modification profile paradigm, and the flow leveling current control modification profile paradigm.

As illustrated in FIG. 5, this base current control profile process 110 results in a characteristic flow versus back pressure curve that is has slowly decreasing flow at low back pressure and rapidly decreasing flow once the current draw is large enough to limit pump speed. But, even though the flow and back pressure are decreasing, the back pressure is still increasing at an undesirable rate.

Pressure Limiting Current Control Modification Profile Process

Figure 3:
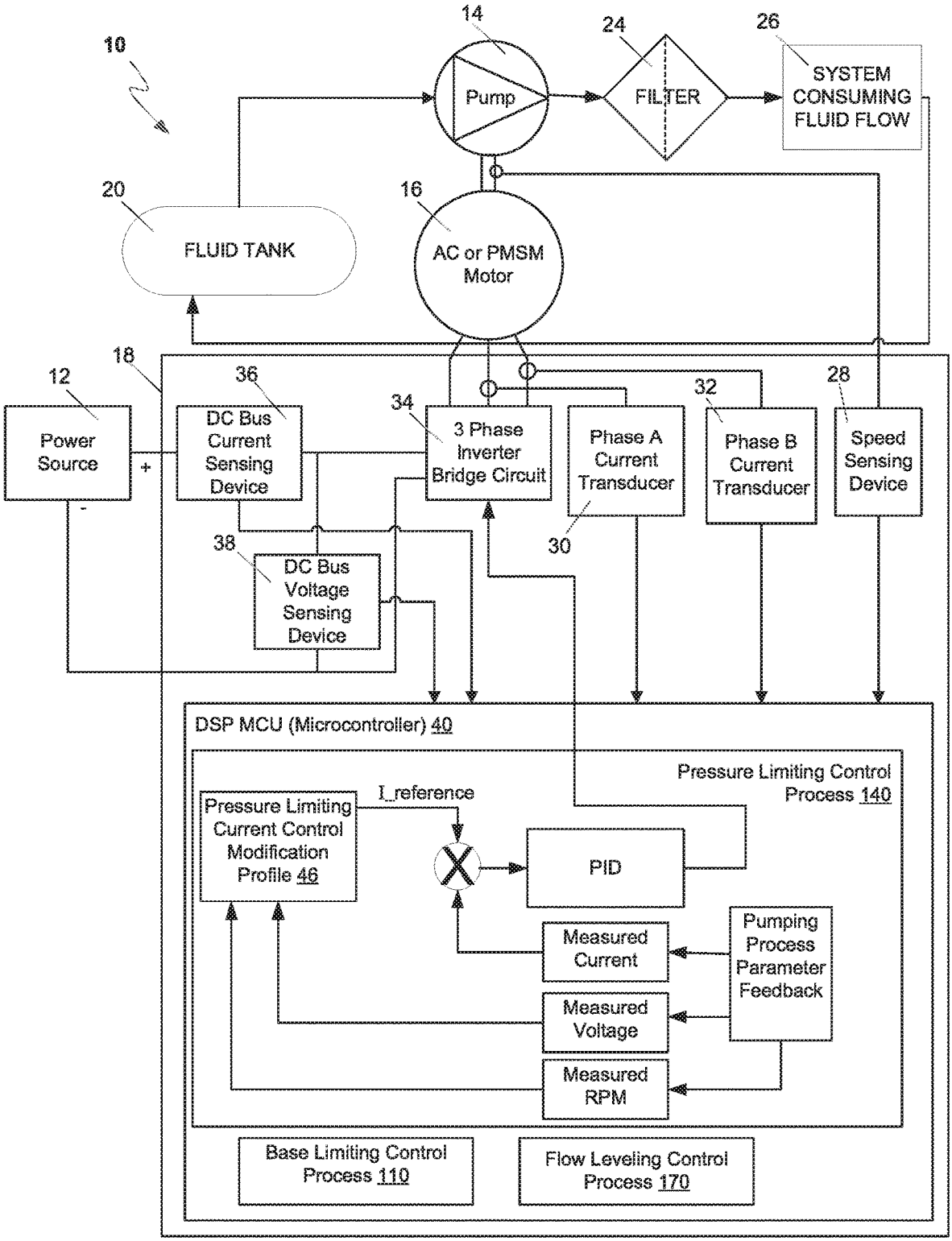
FIG. 3 is a functional block diagram view of an embodiment of the electric pump pressure sensorless electronic pressure limiting and flow leveling system operatively coupled between the fluid tank and at least one filter feeding filtered fluid to the fluid flow consuming system and further illustrating a pressure limiting current control modification profile paradigm.

Accordingly, and referring to FIG. 3, the system provides a modification or cascade to the base current control profile process or method 110 which comprises additionally feeding back the rotor speed and optionally the source input voltage measurement and utilizing these variable parameters in the pressure limiting current control modification profile process 140 that results in a nearly constant maximum back pressure as the system flow restriction increases from nominal all the way to a dead-headed system as illustrated in the pump flow vs. back pressure plot illustrated in FIG. 5.

A dead-headed system is generally defined as a return less fluid delivery system which, in one embodiment, has an exemplification of creation when a downstream filter becomes clogged and substantially closed against a running pump.

In one embodiment the pressure limiting current control modification profile process 140 empirically determines a non-linear reference current correction (Icorrection) profile for defining pressure limiting current control modification profile 46 based on the rotor speed, or optionally but less preferred, the stator frequency.

In turn, the multi-mode process 100 then utilizes this process and associated profile 46 in combination with, and to provide correction for, the reference current value (Iref).

Still referring to FIG. 3, and in one embodiment, a voltage correction is also introduced to the reference current correction for dynamically recalibrating for changes in input source voltage.

Pressure Limiting Current Control Model Training Process RPM/Voltage

In one embodiment, the pressure limiting current control modification profile process 140 comprises a reference current correction (Iref-correction) that utilizes a second order polynomial that is derived from pump performance data.

Input current and rotor speed measurements are taken for the pump at several operating points while operating open loop at selected stator frequencies and nominal voltage. The first data point is taken at the maximum desired current. This corresponds to the flow and back pressure that creates the largest current draw. Usually, the maximum flow that the pump needs to produce for the system at the maximum desired back pressure (FIG. 5, 160). Subsequent data points are taken at lower stator frequency settings with the pump back pressure adjusted to its maximum value, the same back pressure value as the first data point.

The resulting curve or function of input current vs rotor speed (or stator frequency) is then subsequently used as the stored pressure limiting current control modification profile 46 to lookup or calculate the control loop non-linear reference current correction (Irpmcorrection) based on the rotor speed (or stator frequency).

When taking data and developing a reference current curve, there is no reason to maintain the back pressure constant as flow drops. The pump motor torque characteristics may favor reducing the back pressure significantly as the rotor speed decreases. It is noted that from a system perspective, the filter is already clogged beyond the pumps ability to supply full flow to the downstream components (at the maximum back pressure), and therefore reducing flow further to maintain acceptable inverter and/or winding temperatures is a desirable design compromise. Accordingly, and in one embodiment, the quadratic model is replaced with a model utilizing one or more line segments as a best fit to the data.

Additionally, an in one embodiment, voltage correction is also employed to control maximum back pressure in systems where input source voltage can vary several percent.

Motor torque varies approximately with the square of input voltage (nonlinear). A 2% change in input voltage will change motor torque approximately 4%. When input voltage is above nominal a reduction in the reference current is required to decrease flow and back pressure. Voltage below nominal requires an increase in the reference current. If the nominal reference current is already at the motor or inverter rated value, then no margin is available to increase the current and compensate for the decreased input voltage.

In one embodiment, the voltage correction profile is determined by running the pump 14 open loop and manually adjusting the stator frequency (or rotor speed for synchronous motors) to maintain the desired back pressure as voltage varies. Starting at the nominal operating point of maximum flow and reference current, decrease the voltage in appropriate increments and at each point adjust the stator frequency until the nominal or desired back pressure is restored. At this steady-state condition, record the source input current draw, voltage, and rotor speed.

A resulting curve or function fit to these points is then subsequently used as a stored profile to lookup or calculate the voltage correction (Ivcorrection) that is also introduced to the rpm correction (Irpmcorrection) to obtain the reference current correction (Iref-correction) that forms a correction profile for the PID reference current.

Accordingly, and in one aspect, the system 10 dynamically adjust the PID reference current in response to source voltage changes for driving a change in pump RPM that maintains back pressure as voltage varies.

Flow Leveling Current Control Modification Profile Process

Figure 4:
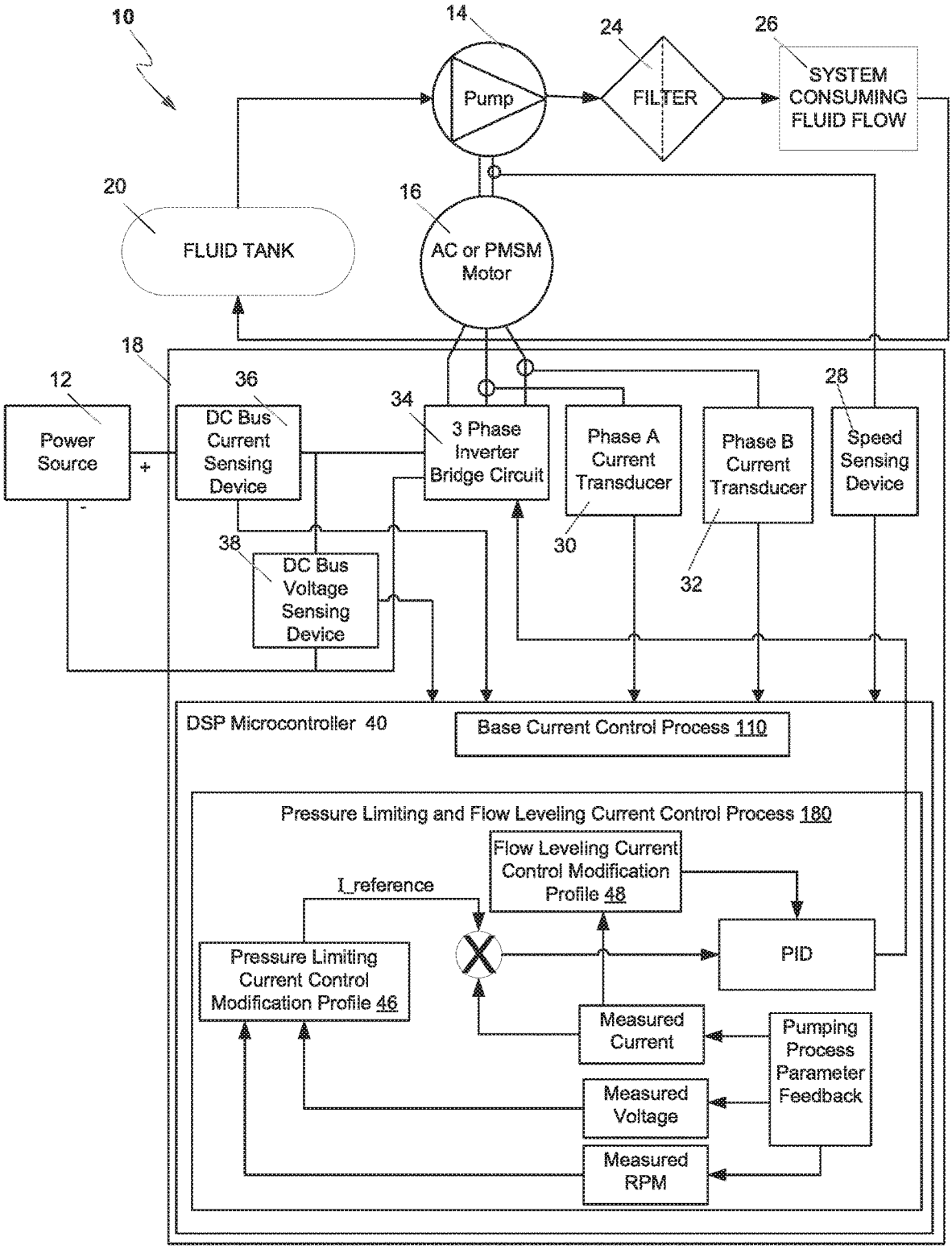
FIG. 4 is a functional block diagram view of an embodiment of the electric pump pressure sensorless electronic pressure limiting and flow leveling system operatively coupled between the fluid tank and at least one filter feeding filtered fluid to the fluid flow consuming system and further illustrating the pressure limiting current control modification profile paradigm in combination with a flow leveling current control modification profile paradigm.

Referring to FIG. 4, an embodiment of the system 10 further comprises the flow leveling control process 170 or, in particular, a flow leveling current control modification profile process 170 (FIG. 1) that is introduced to maintain near constant flow from the pump 14 as the back pressure varies across the operating range.

This flow leveling current control modification profile process 170 is separate from and may work in combination with the pressure limiting current control modification profile process 140.

In one embodiment, flow leveling current control modification profile process 170 is determined by running the pump open loop across a range of back pressures up to the predefined maximum pressure value. For each back pressure value, the pump speed is adjusted to achieve the desired pump flow. At each point the stator frequency is recorded along with the associated current draw. Then, a process of fitting a second order polynomial through the data is performed to provide a function for the maximum operating speed allowed at any current draw.

A resulting flow correction curve or function fit to these points is then subsequently stored in memory 44 as a flow leveling profile 48 and used to maintain near constant flow from the pump as the back pressure varies across the operating range.

Compared to the RPM required at the point of maximum current draw and back pressure, the flow correction profile limits the pump RPM at lower back pressures so that the pump flow will not increase (due to improved volumetric efficiency) as the back pressure decreases, but remain steady.

This second order flow correction profile is used as the PID control loop output maximum limit. The maximum output stator frequency is then a function of the measured steady state current draw. At back pressures below maximum current draw the PID output is set by this function because in this current range the PID control loop wants to increase the pump speed trying to drive the error signal to zero and therefore will output the maximum limit. Therefore at different back pressures the pump 14 will run at speeds achieving nearly constant flow.

In one embodiment, the step of developing the correction profile for constant flow may include adding an additive slope adjustment and intercept offset to the second order or quadratic function developed. Adjusting these two values allows for quick tuning to bring the flow to a near constant value with minimal effort.

Multi-Mode Control Process/Method

In fluid pumping applications using positive displacement pumps, the pump creates flow. The restriction to the flow created by the system downstream from the pump creates pump back pressure. When the pump is powered with a constant speed electric motor (such as an induction motor), for a given input voltage the motor's current draw will increase with increasing pump back pressure. For a variable speed electric motor, the current draw will vary with both the commanded pump speed (which controls the fluid flow rate) and pump back pressure.

In fluid systems that include filtration downstream of the pump, the system restriction and therefore pump back pressure increases as the filter clogs. As back pressure increases, the pump electrical motor must draw increased current to maintain flow. The current draw must be maintained within the rated capacity of the device. If the pressure climbs too high and the motor torque necessary to drive the pump against the pressurized fluid surpasses the motor's torque capability, the pump will stall. Both conditions can lead to failure of the pump motor and/or electronic motor drive.

High back pressure will also cause various mechanical failures if a system is not designed properly. The pump can see excessive loading causing failure or accelerated wear. Similarly, system components downstream of the pump, such as hoses, hose fittings, filters canisters, and manifolds, can leak or fail.

To protect against over pressurization in these systems, the system 10 comprises a multi-mode control process 100 comprising coded instructions that are stored in the program memory 42 of the microcontroller 40 for controlling the motor 16 for driving pump 14 for pumping fluid such as fuel to, for example, to the fluid flow consuming system 26. Specifically, the coded instructions stored in program memory 42 of the microcontroller 40 comprise the base current control profile process 110, the pressure limiting current control modification profile process 140, and the flow leveling current control modification profile process 170 respectively illustrated in the flowcharts of FIGS. 6 through 8. Accordingly, the pump will regulate its speed and therefore the maximum flow and pressure according to the process depicted in the flow charts illustrated in FIGS. 6 through 8.

Base Current Control Profile Process

FIG. 6 illustrates a detailed flowchart of one embodiment of the base control mode process. This process is also described in U.S. Pat. No. 8,707,832 which is incorporated herein by reference in its entirety as though fully set forth herein and which has an inventor in common with the inventor of the present application.

The base control mode process 110 commences with process block 112 for a PID error signal by taking the difference between the reference current and the DC bus measured current.

In process block 114, a delta-error term is calculated and stored by taking the difference between the current error value (process block 112) and the error calculated during the previous pass through the loop, the last error calculated (process block 134).

Next, the process flows to process block 116 for calculating the proportional and derivative error values and adds them to the total PID output. Specifically, the output is equal to the last output stored plus a predefined proportional coefficient times the current error plus a predefined derivative coefficient times a delta error divided by a delta time where delta time is constant at a fixed frequency.

Then the process flows to process block 118 for storing the output calculated in process block 116 as Output Temp.

Next, the process flows to decision block 120 for determining if the output is greater than a predefined output maximum and if yes, then output is defined as the output maximum at process block 128. If no, decision block 122 determines if the output is less than a predefined output minimum. If the result of decision block 122 is yes, then the output is defined as the output minimum at process block 126 and, if no, then the output is defined at process block 124 as the previously stored output in process block 118. Then, one of these three outputs is passed to process block 130 for defining the output value.

Accordingly, the logic shown by process blocks 120, 122, 124, 126, and 128 limit the PID output to an acceptable range. Since the output value is the pump motor frequency, this range check prevents the PID loop from commanding a pump speed that is outside a preset range.

Boxes 120 and 122 show the upper and lower range comparisons, respectively. If the output value is greater than or less the boundary values, then the output value is assigned the range limit value. If the output value is not out of range, the value is left unchanged (process block 124).

In process block 130 the PID loop output value is assigned. For the case of induction motors, this is the stator frequency. For synchronous motors, this value is both the stator frequency and pump speed.

In process block 132, the integral error is added to the total PID output. Specifically, the output is set to the Output Temp value plus a predefined integral coefficient times the value obtained by taking the difference between the error and the Output Temp value minus the output value. The terms of this equation as well as the entire sequence of the algorithm do not allow 'windup.' Windup is the continued accumulation of error when the output of the loop has exceeded the allowable range. Finally, process block 134 stores the error obtained at process block 132 as the last error and base control mode process 110 ends and is ready to repeat. There are additional ways this algorithm can be formulated to achieve the same result.

Pressure Limiting Current Control Modification Profile Process

FIG. 7 illustrates the pressure limiting current control modification profile process 140 comprising the steps of the base control mode process and additional process steps for determining the reference current as a function of a previously trained profile correlating a predefined reference current value from the profile as a function of the measured voltage and rpm wherein the correlated predefined reference current value is utilized as the reference current in calculating error (reference current minus DC Bus Current) to limit the maximum pressure that can be developed by the pump.

Process blocks 142 and 144 show the stator frequency for an AC motor or RPM for a synchronous motor along with the source supplied voltage measurements necessary to calculate a new reference current for the PID loop. These two corrections shown are, but are not limited to being, quadratic and additive (process block 146), wherein these mathematical formulations correlate a profile reference current to measured voltage and speed or frequency. Accordingly, an aspect of this process is to change the reference current of the PID loop by a prescribed function of the voltage and speed or frequency. Process blocks 148 and 150 assure that the determined reference current does not exceed a predefined maximum reference current and, if so, sets the reference current to the maximum predefined value.

It is noted that limiting pressure at constant voltage requires a reduction in current. Therefore the reference current calculated in process block 146 from the pump RPM will be less than the maximum reference current the pump is allowed to draw at higher RPMs. Note that the steady-state current draw at any RPM will be less than the reference current draw until the at least one filter 24 (FIG. 1) is sufficiently clogged to raise the pump back pressure for the given flow. As the filter 24 clogs, the pump back pressure builds and concomitantly the pump current draw increases. When the filter is sufficiently clogged the pump current draw will then run into the limits imposed by the calculation in process block 146. The reference current range check in process block 128 effectively limits the use of the reference current calculated in process block 146 to a specific RPM range characteristically larger than the RPM and back pressure required to cause the pump to draw maximum current. Therefore the control process in FIG. 7 will cause the pump to run at maximum RPM (process block 128) until the maximum current is achieved due to increasing back pressure. At this point, the pump will decrease RPMs as the reference current calculated in process block 146 begins decreasing.

The voltage correction in process block 146 can either increase or decrease the calculated reference current. If the voltage supplied to the pump motor increases, the current draw must decrease for any given RPM and torque on the pump motor. Therefore if voltage increases above nominal the voltage correction in process block 146 must decrease the reference current. If the voltage drops below nominal, the current draw (or the slip in an AC motor or the voltage duty in a synchronous motor) must increase to maintain torque and therefore flow and pressure. Depending on the current margin available in the system, it may not be possible to compensate for low voltage conditions.

Flow Leveling Current Control Modification Profile Process

FIG. 8 illustrates the flow level current control process 170 or, in particular, a flow leveling current control modification profile process 170 comprising process blocks 172, 174, and 178 along with decision process block 176 and further comprising the steps of the base control mode 110 to level the flow that the pump will produce for a given back pressure. In one embodiment, the flow leveling current control modification profile process 170 further comprises the pressure limiting current control modification profile process 140.

More specifically, the level or constant flow current control process 170 depicted in blocks 172, 174, 176, and 178 limit the maximum RPM the control loop can output. This allows compensation for changes in pump volumetric efficiency as back pressure builds. At low back pressure, the pump must be slowed down relative to a given flow at a higher back pressure. The reduction in RPMs compensates for improved volumetric efficiency due to decreased internal recirculation.

The correction calculated in block 174 is the maximum PID control loop output value (stator frequency) as a function of the measured current. The range check in block 176 prevents the equation in block 174 from producing an output that exceeds the maximum desired pump speed. The maximum speed is determined at the point of maximum flow and back pressure (point of maximum current, FIG. 5, 160). At back pressures below this value the equation in block 174 will slow the pump to maintain steady flow.

Profile Training/Calibrating Process

Prior to mass production, the pump must be calibrated for a particular application by determining the control algorithm coefficients shown in FIGS. 6 through 8, namely a1-a3, b1-b3, and c1-c3. The pump speed and pump current draw limits in FIGS. 6 through 8 must be determined as well.

In order to determine these values, the pump must be run open loop, meaning that the only commanded pump variable is the stator frequency. All other control algorithms that would cause the stator frequency to vary must be disabled.

Additionally, a means to vary the system back pressure must be plumbed into the test system. Typically a needle valve would be employed for this purpose, inserted downstream of the pump either in line with the filter 24 (FIG. 1) or in place of it and before a flow regulating valve. By varying the stator frequency and pump back pressure, the pump can be exercised through its entire operating envelop and for each point, the rotor RPM and current draw measured and recorded.

Profile Training for coefficients a1, b1, and c1

The first point to determine is shown on FIG. 5 at 160. This is the point of maximum back pressure desired for the system. At nominal voltage, the current draw and pump speed at this point are the maximum values used in FIGS. 7 and 8, process block 148 and 128. At back pressures above this point data is collected for current and RPM that determine the coefficients a1, b1, and c1 in process block 146 of FIGS. 7 and 8.

To collect data points, starting at the back pressure at FIG. 5 point 160, increase the back pressure further by increasing the system restriction. After the pressure increase, the stator frequency is reduced to bring the pump back pressure back to the same values as FIG. 5 point 160. The pump RPM and current draw are then recorded.

This procedure is repeated for several points until the system orifice is fully closed. The resulting data is then plotted, current vs RPM, and a second order polynomial curve fit is derived yielding the a1, b1, and c1 coefficients in process block 146 of FIGS. 7 and 8.

Profile Training for coefficients a2, b2, and c2

Deriving the coefficients for a2, b2, c2 in process block 146 of FIG. 7 coefficients is a similar procedure. Again starting at FIG. 5, point 160, increase (or decrease) the input voltage by 20% of the total planned deviation from nominal. The pump will speed up (or slow down) and the pump back pressure will increase (or decrease).

Then, adjust the stator frequency, bringing the pump back pressure back to the desired maximum value and record the input voltage and difference in current draw between the nominal and changed voltage.

After repeating this process for the additional voltage variations (40%, 60%, 80%, 100%), plot the current difference versus voltage and apply a second order curve fit. The curve will yield the a2, b2, and c2 coefficients. This polynomial expression in FIGS. 7 and 8, blocks 146 will add or subtract to the reference current, allowing more or less current draw, compensating for the change in supply voltage.

Profile Training for coefficients a3, b3, and c3

To level flow over the pumps back pressure range the coefficients a3, b3, c3 in FIG. 8, process block 174 must be determined. Starting with the pump running at FIG. 5, point 160, the system back pressure is decreased approximately 20%. Then the stator frequency is reduced until the flow is the same as the flow at FIG. 5, point 160. The current draw and stator frequency (or pump RPM for a synchronous motor) is recorded.

This process is repeated in approximately 20% intervals until the artificial system restriction is fully removed. Plotting the resulting stator frequency (or pump RPM) versus current draw, fitting a second order polynomial to the curve, produces the coefficients a3, b3, c3 for FIG. 8, process block 174.

The motor type used in the pump can determine other aspects of the overall pump control strategy. For an AC induction motor, having the rotor speed as an input to the reference current correction (FIGS. 7 and 8, blocks 144) is preferred. This can be measured directly with speed sensing device 28 shown in FIG. 1 or calculated if vector control is employed using current measurements with phase current transducers 30 and 32 illustrated in FIG. 1. If the pump motor is synchronous, the hall commutation sensors will provide the rotor speed.

Depending on the motor type, other control processes in addition to those disclosed herein may need to be employed to control motor speed. For example, in a synchronous motor, the voltage duty may be varied to achieve a desired pump speed using either trapezoidal or sinusoidal commutation. In an AC induction motor using vector control, the torque (q) component of the vector control algorithm may be varied to achieve the desired pump speed. Regardless of the motor type, the algorithm disclosed herein can be implemented and inserted into the overall control scheme.

In Use and Operation

In use and operation, and referring to the drawings, the system 10 can be employed in a fuel delivery system to an engine providing the fluid flow consuming system 26 wherein the system 10 is devoid of a mechanical pressure regulating valve and also optionally devoid of a mechanical flow regulating valve.

The system 10 initiates when a vehicle system provides power to the pump motor/controller. On power up, the pump motor 16 will turn, spin the pump 14, pull fluid in the form of fuel from the fluid tank 20 and provide fuel flow through at least one filter 24 and to the system 26 consuming fuel flow downstream.

As depicted in FIG. 1-3, flow is either consumed by the system or is bypassed back to the tank by the system consuming the flow. As the pump continues to run, the filter (FIG. 1-3, item 24) will clog as contaminants contained in the fuel are removed. The clogging filter on the vehicle system can be thought of as an orifice that is slowly decreasing in cross sectional area. As the orifice size decreases, the back pressure on the pump increases for a given flow as well as the pump motor current draw.

The systems initially runs the base current control profile process or base current control PID process 110 and then responds to increasing back pressure created by the vehicle system due to filter clogging by running the pressure limiting current control modification profile process 140 utilizing the empirically determined RPM correction profile and optionally the source voltage correction profile to adjusts the pump output to limit the maximum back pressure produced and also running the flow leveling current control modification profile process 170 to limit the flow output at lower back pressures to create near constant flow as a function of back pressure or, in other words, maintain near constant flow from the pump as the back pressure varies across the operating range.

Accordingly, the electric pump pressure sensorless electronic pressure and flow limitation system 10 can be specifically employed in, but not limited to, a fuel transfer pump system for controllably delivering fuel to, for example, a high pressure fuel injection pump. In turn, and in one embodiment, the high pressure fuel injection pump delivers high pressure fuel in fluid communication with fuel injectors that deliver fuel to individual engine cylinders under the control of a mechanical system or an electronic or engine control unit (ECU) system.

Additionally, an aspect of the system 10 apparatus and method is to set a maximum limit on the pressure a pump can create in a given system within an acceptable tolerance.

Furthermore, an aspect of the system 10 apparatus and method is to provide fluid flow from the pump in that is made nearly constant relative to pump back pressure up to the maximum pressure value.

The above delineation of the system 10: apparatus and method, including its use and operation, demonstrates the industrial applicability of this invention.

Moreover, it should be apparent that numerous modifications and adaptations may be resorted to without departing from the scope and fair meaning of the instant invention as set forth hereinabove and as described herein below by the claims.

I claim:

1. A method for controlling a fluid pump delivering a fluid through a filter feeding a fluid consuming system; said method comprising the steps of:

providing the fluid pump having an inlet port which is connectable in fluid communication with a fluid source and an outlet port which is connectable in fluid communication with the filter feeding the fluid consuming system;

providing a motor for driving the fluid pump for drawing the fluid through the inlet port from the fluid source, pressurizing the fluid, and pumping the fluid that was pressurized out the outlet port and through the filter feeding the fluid consuming system;

measuring a current utilized in operating the motor for driving the fluid pump;

controlling an operating speed of the motor driving the fluid pump as a function of the current that was measured and a reference current for defining a closed loop current control mode;

measuring the operating speed of the motor driving the fluid pump and measuring a voltage utilized in operating the motor for driving the fluid pump;

correlating the operating speed that was measured and the voltage that was measured to a value in a pressure limiting correction profile for defining a correlated correction profile value;

transitioning from the closed loop current control mode to a pressure limiting control mode for controlling the operating speed of the motor by utilizing the correlated correction profile value from the pressure limiting correction profile for setting the operating speed of the motor driving the fluid pump for drawing the fluid through the inlet port from the fluid source, pressurizing the fluid, and pumping the fluid that was pressurized out the outlet port and through the filter feeding the fluid consuming system;

wherein the transitioning from the closed loop current control mode to the pressure limiting control mode is a function of an increasing back pressure on the fluid pump created by a clogging of the filter; and wherein the method is performed without measuring a fluid pressure.

2. The method of claim 1, wherein the correlated correction profile value is a correlated correction profile current value.

3. The method of claim 2, wherein the step of utilizing the correlated correction profile value to set the operating speed of the motor driving the fluid pump comprises a step of determining a difference between the correlated correction profile current value and a DC bus current value for defining an error value.

4. The method of claim 3, wherein the step of utilizing the correlated correction profile value to set the operating speed of the motor driving the fluid pump comprises a step of utilizing the error value for setting the operating speed of the motor driving the fluid pump for drawing the fluid through the inlet port from the fluid source, pressurizing the fluid, and pumping the fluid that was pressurized out the outlet port and through the filter feeding the fluid consuming system.

5. The method of claim 4, wherein the pressure limiting correction profile is predetermined as a function of an anomalous condition indicative of the clogging of the filter.

6. The method of claim 5, wherein the fluid consuming system is an engine of a vehicle.

7. A system for controlling a fluid pump delivering a fluid through a filter feeding a fluid consuming system; said system comprising:

the fluid pump having an inlet port which is connectable in fluid communication with a fluid source and an outlet port which is connectable in fluid communication with the filter feeding the fluid consuming system;

a motor for driving the fluid pump for drawing the fluid through the inlet port from the fluid source, pressurizing the fluid, and pumping the fluid that was pressurized out the outlet port and through the filter feeding the fluid consuming system;

means for measuring a current utilized in operating the motor for driving the fluid pump;

means for controlling an operating speed of the motor driving the fluid pump as a function of the of the current that was measured and a reference current for defining a closed loop current control mode;

means for measuring the operating speed of the motor driving the fluid pump and measuring a voltage utilized in operating the motor for driving the fluid pump;

means for correlating the operating speed that was measured and the voltage that was measured to a value in a pressure limiting correction profile for defining a correlated correction profile value; and a microcontroller for transitioning from the closed loop current control mode to a pressure limiting control mode for controlling the operating speed of the motor by utilizing the correlated correction profile value from the pressure limiting correction profile to set the operating speed of the motor driving the fluid pump for drawing the fluid through the inlet port from the fluid source, pressurizing the fluid, and pumping the fluid that was pressurized out the outlet port and through the filter feeding the fluid consuming system;

wherein the transitioning from the closed loop current control mode to the pressure limiting control mode is a function of an increasing back pressure created by a clogging of the filter; and wherein the system does not measure a fluid pressure.

8. The system of claim 7, wherein the means for correlating the operating speed that was measured and the voltage that was measured to the value in the correction profile for defining the correlated correction profile value comprises means for correlating the operating speed that was measured and the voltage that was measured to a predefined reference current value in the correction profile for defining the correlated correction profile value.

9. The system of claim 8, wherein utilizing the correlated correction profile value from the pressure limiting correction profile to set the operating speed of the motor driving the fluid pump comprises determining a difference between the correlated correction profile value and a DC bus current value for defining an error value.

10. The system of claim 9, wherein utilizing the correlated correction profile value from the pressure limiting correction profile to set the operating speed of the motor driving the fluid pump comprises utilizing the error value to set the operating speed of the motor driving the fluid pump for limiting a maximum pressure that is developed by the fluid pump for drawing the fluid through the inlet port from the fluid source, pressurizing the fluid, and pumping the fluid that was pressurized out the outlet port and through the filter feeding the fluid consuming system.

11. The system of claim 10, wherein the pressure limiting correction profile for defining the correlated correction profile value is predetermined as a function of an anomalous condition indicative of the clogging of the filter.

12. The system of claim 11, wherein the fluid consuming system is an engine of a vehicle.

* * * * *